US007044762B1

(12) United States Patent
Hong et al.

(10) Patent No.: US 7,044,762 B1
(45) Date of Patent: May 16, 2006

(54) WATERPROOF CONNECTOR

(75) Inventors: Kin Boon Hong, Singapore (SG); Sen Khim Ho, Singapore (SG); Akira Nagamine, Aichi-ken (JP)

(73) Assignees: MEA Technologies Pte. Ltd., (SG); J.S.T. Mfg. Co. Ltd., (JP)

( * ) Notice: Subject to any disclaimer, the term of this patent is extended or adjusted under 35 U.S.C. 154(b) by 0 days.

(21) Appl. No.: 11/189,071

(22) Filed: Jul. 25, 2005

(30) Foreign Application Priority Data

Jun. 1, 2005 (SG) ..... 2005-03472-3

(51) Int. Cl.
*H01R 13/52* (2006.01)

(52) U.S. Cl. ..... 439/275; 439/281; 439/278; 439/283

(58) Field of Classification Search ..... 439/275, 439/278, 281, 283
See application file for complete search history.

(56) References Cited

U.S. PATENT DOCUMENTS 5,197,899 A * 3/1993 Akeda ..... 439/271
5,668,698 A * 9/1997 Jozwiak et al. ..... 361/752
6,558,179 B1 * 5/2003 Nakamura et al. ..... 439/275

FOREIGN PATENT DOCUMENTS

JP 01-117281 A 5/1989
JP 08-096905 A 4/1996
JP P2001-160452 A 6/2001

OTHER PUBLICATIONS

Patent Abstracts of Japan; English Abstract of Publication No. 01-117281 A; 1 page.
Patent Abstracts of Japan; English Abstract of Publication No. 08-096905 A; 1 page.
Paten Abstracts of Japan; English Abstract of Publication No. P2001-160452 A; 1 page.

* cited by examiner

*Primary Examiner*—Truc Nguyen
(74) *Attorney, Agent, or Firm*—Osha Liang LLP

(57) ABSTRACT

The connector of the present invention refers to a waterproof connector that includes contact terminals connected to the contact terminals of another connector in a contact manner, a main body housing that has a through hole for housing the contact terminals, and a tubular connector seal that consists of an elastic member fitted around the circumference of the main body housing, where the connector seal is pressed against the inner circumference wall of the housing of the other connector when the waterproof connector is connected to such other connector in a fitted manner to prevent water from permeating the connector, whereby a tubular sliding hood is installed on the connector seal as to be freely slidable in the main body housing, and is pushed down to the tip of the housing of the other connector in the process of connection, while the connector seal is pressed against the inner circumference wall of the housing of the other connector.

According to the present invention, it is possible to provide a small and thin waterproof connector where the outer tubular portion serving as a housing is no longer necessary as indicated in prior art, as it is serves to prevent dirt, dust or the like from attaching and at the same time, prevent water from permeating the connector, thereby facilitating connection with another connector in good condition.

10 Claims, 6 Drawing Sheets

WATERPROOF CONNECTOR

BACKGROUND OF THE INVENTION

1. Field of the Invention

The present invention relates to a waterproof connector, more particularly to a waterproof connector in which a sealing member is installed to the housing of a connector to prevent water from permeating the connector originating from a connected portion when the connector is connected to another connector.

2. Prior Art

A waterproof connector unit, which consists of a male connector and a female connector, whereby a sealing member is applied between the male and female connectors to prevent water originating from the connected portion from permeating the connector, has been disclosed in Japanese Laid-Open Patent Publication No. 8(1996)-45601.

A waterproof connector unit 40 described in the above-mentioned laid-open patent publication is provided with a male housing 41 and a female housing 50, as shown in FIG. 6. The male housing 41 is provided with a tubular portion 42 directed at a connecting side, in which a fitting portion 42a with a large diameter, a step portion 42b and a fitting portion 42c with a small diameter are formed. A locking protrusion 43 directed towards a connecting direction in an approximately perpendicular way is formed on the outside surface of the tube portion 42, with the rear surface of the locking protrusion 43 serving as an engaging surface 43a. A terminal 44 is housed in the male housing 41.

On the other hand, the female housing 50 is provided with an inner tube portion 51 which is fitted into the fitting portion 42c of the male housing 41, and an outer tube portion 52 for inserting the tube portion 42 between the inner tube portion 51 and the outer tube portion 52, while a flange-shaped limiting portion 53 is provided at the base portion of the inner tube portion 51. The inside of the inner tube portion 51 has a terminal housing hole 54, while a locking arm 55 is provided between the inner tube portion 51 and the outer tube portion 52 for engaging with the locking protrusion 43 of the male housing 41. Further, a tubular elastic member 56 for waterproof purposes is fitted around the circumference of the inner tube portion 51.

The male housing 41 and the female housing 50 are connected in such manner that the tubular elastic member 56 is made to fit the inner tube portion 51 of the female housing 50 by means of a flange portion 56b and the male housing 41 is thereafter pushed down to the female housing 50 such that the inner tube portion 51 and the tubular elastic member 56 fit into the fitting portion 42c and the fitting portion 42a, respectively. In this manner, shaking of the connected portion is designed to be eliminated and render it waterproof.

The waterproof connector unit is composed of the male housing 41 and the female housing 50, which includes the outer tube portion 52 of a large diameter and the inner tube portion 51 of a small diameter, with the outer tube portion 52 being concentrically disposed in relation to the inner tube portion 51, and the fitting portion 42 of the male housing 41 being inserted between them, and is locked by a locking arm.

According to this waterproof connector unit, a gap must be provided between the inner tube portion 51 and the outer tube portion 52 for the fitting portion 42 of the male housing 41 and the locking arm, but when such gap becomes relatively wide, the outer shape of the housing becomes significantly deformed. Further, because of the existence of the gap, a part of the tubular elastic member is exposed to the outside, although the tubular elastic member is housed in the outer tube portion 52 of a large diameter. For this reason, dust, dirt or the like easily attaches to the elastic member as to affect its waterproofness when it is connected to the male housing 41. Furthermore, since waterproof means is not applied to the rear surface of the connector housing, particularly the area near the terminal inserting port, there are cases where water permeates or penetrates this area.

Moreover, since the tube portion of the male housing 41 and the outer tube portion of the female housing 50 overlap when the two are connected to each other, this type of waterproof connector unit cannot be made smaller.

SUMMARY OF THE INVENTION

The present invention has been created to address the problems associated with the waterproof connector unit disclosed in the prior art mentioned above.

The first object of the present invention is to provide a small-sized waterproof connector that does not require the outer tube portion of the housing of the connector of the above-described publication. The second object of the present invention is to provide a waterproof connector where the sealing member of the connector is covered by a freely movable hood designed to protect the same.

These objectives can be achieved by the following means. Specifically, the waterproof connector of the present invention referred to in claim 1 is a waterproof connector comprising contact terminals connected to the contact terminals of another connector in a contact manner, a main body housing that has a through hole for housing the contact terminals, and a tubular connector seal that consists of an elastic member fitted around the circumference of the main body housing, where the connector seal is pressed against the inner circumference wall of the housing of the other connector when the waterproof connector is connected to the latter connector in a fitted manner to prevent water from permeating the connector, whereby a tubular sliding hood is installed in the main body housing as to be freely slidable on the connector seal that has been fitted to the main body housing, and the sliding hood is pushed down to the tip of the housing of the other connector when connecting to the said connector, and the connector seal is pressed against the inner circumference wall of the housing of such other connector.

The waterproof connector of the invention described in claim 2 refers to the waterproof connector of claim 1, in which the main body housing comprises an insertion with a projected portion that is connected to the other connector in a fitted manner and a fixing portion for fixing lead wires connected to the contact terminals, and the insertion with a projected portion is longer than the fixing portion in the longitudinal direction.

The waterproof connector of the invention described in claim 3 is the waterproof connector of claim 1, in which the sliding hood consists of an elastic tubular member and engaging portions which are formed on the elastic member, the engaging portions being engaged with locking protrusions provided on the main body housing when it is not connected to another connector.

The waterproof connector of the invention described in claim 4 is the waterproof connector of claim 2 or 3, in which a locking mechanism is provided on the circumference wall of the fixing portion of the main body housing to engage the other connector.

The waterproof connector of the invention described in claim 5 is the waterproof connector of claim 4, in which the sliding hood and guide protrusions and notched grooves having a predetermined length are respectively formed on the inner circumference wall and sidewalls of the tubular body, the guide protrusions being engaged with guide rails provided on the main body housing, and the notched grooves are disposed as to slide while crossing the support arms of the locking mechanism when the waterproof connector is connected to the other connector.

The waterproof connector of the invention described in claim 6 is the waterproof connector of claim 2, in which a cavity is formed at one side of the fixing portion of the main body housing, where the contact terminals are inserted, and a sealing member is installed inside the cavity as to be freely detachable.

The invention described in claim 7 is the other connector to be connected to the waterproof connector of any one of claims 1 to 6, comprising contact terminals and a housing which includes a cavity into which the insertion with a projected portion is fitted, for housing the terminals.

BRIEF DESCRIPTION OF THE DRAWINGS

FIG. 2A is a top view of a sliding hood used in the connector of FIG. 1, while

FIG. 3A is a perspective view of a connector assembly of FIG. 1, while

DETAILED DESCRIPTION OF THE PREFERRED EMBODIMENTS

The preferred embodiments of the present invention will be explained hereafter with reference to the drawings. However, while the embodiments illustrated below exemplify the technical concept of the waterproof connector of the present invention, they are not intended to restrict the application of the present invention to such waterproof connector, since other embodiments may also be applicable to the present invention provided they fall within the scope of claims.

Figure 1:
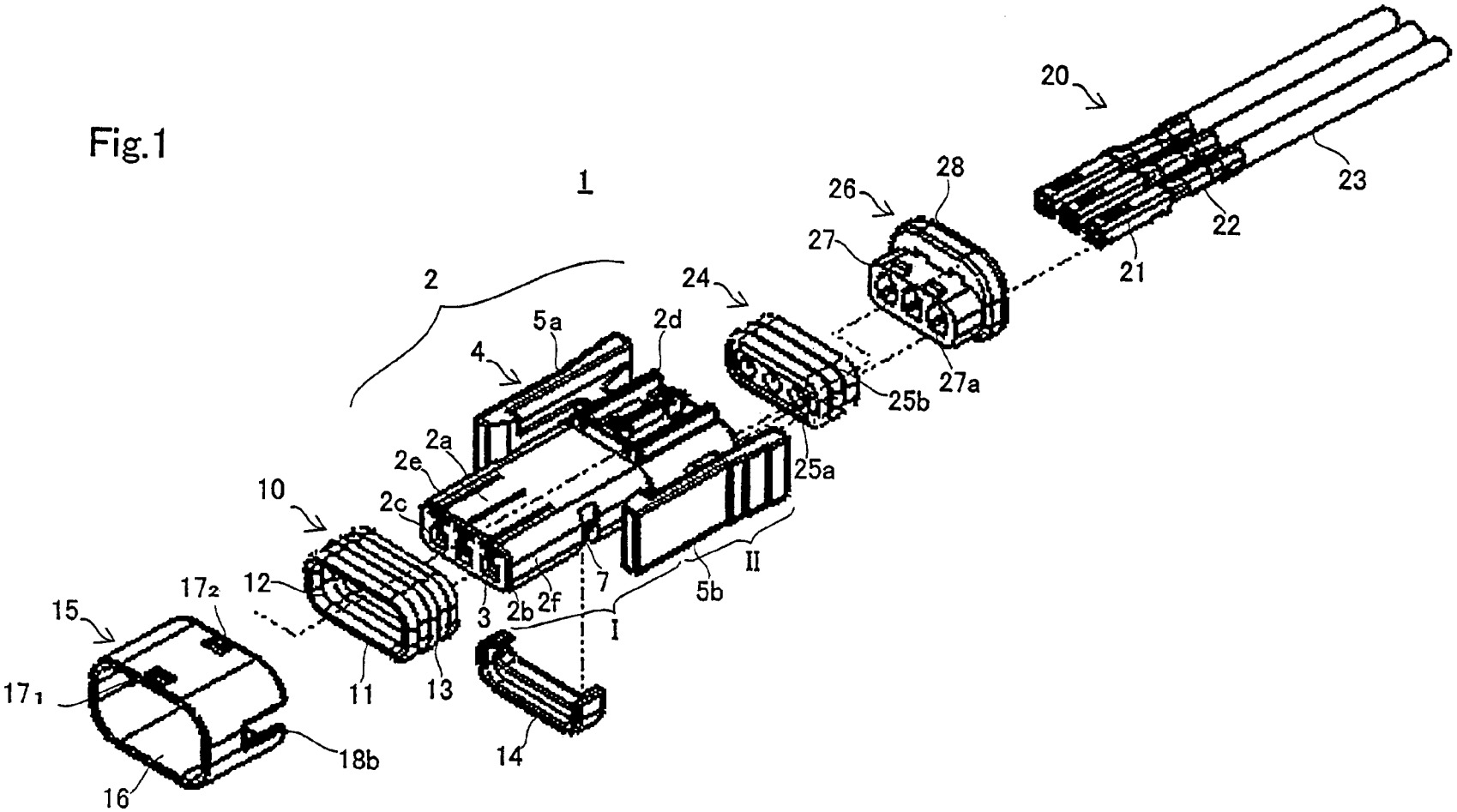
FIG. 1 is an exploded perspective view of a waterproof connector according to embodiments of the present invention.
Figure 4A:
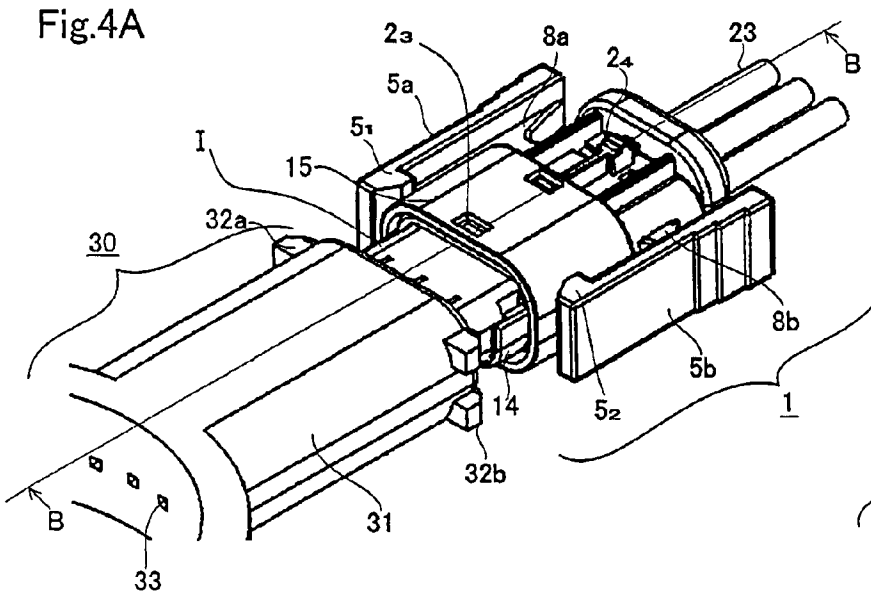
FIG. 4A and FIG. 4B are perspective views illustrating the state of connection between the waterproof connector and another connector according to the embodiments of the present invention.
Figure 4B:
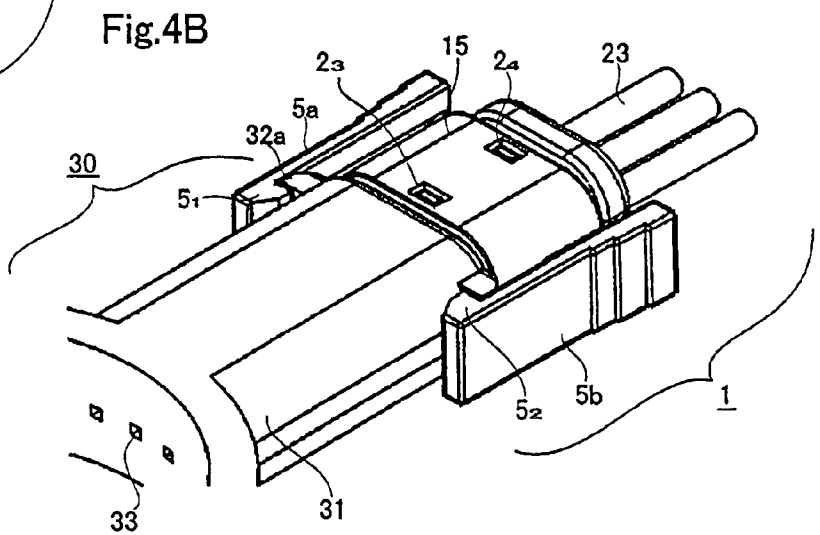

A waterproof connector 1 comprising a plurality of contact terminals 20, a main body housing 2 to which the contact terminals 20 are installed, and a sealing member 10 attached to the main body housing 2, is connected to another connector 30 (refer to FIGS. 1 and 4). The sealing member 10 consists of a connector seal 11 fitted to one end of the main body housing 2, and a sliding hood 15 that is movable as to be freely slidable on the connector seal 11.

As shown in FIG. 1, the main body housing 2 consists of a flat block body made of synthetic resin material having a predetermined width, height, and length. The flat main body housing 2 has a wide top surface 2*a* and a wide bottom surface 2*b*, a front surface 2*c* and a rear surface 2*d*, each of which have a relatively low height and two sidewalls (2*e*, 2*f*) with a relatively narrow width. Further, the main body housing 2 comprises a projected portion I (front part) fitted into the cavity of another connector and a fixing portion II (rear part) in which the contact terminals 20 are inserted with lead wires 23 that are connected to the terminals 20 being disposed along the longitudinal direction, and the length of projected portion I is greater than that of the fixing portion II.

When the length of the projected portion I is made larger than that of the fixing portion II, the connector can be inserted into the housing further deeply when connected to another connector, thereby making the connection stable. Consequently, the state of connection remains stable even without the outer tube portion of the housing in the prior art. In addition, the distance from the outside to the contact terminals gradually increases as to prevent water from permeating the connector, thereby making it waterproof.

Figure 3A:
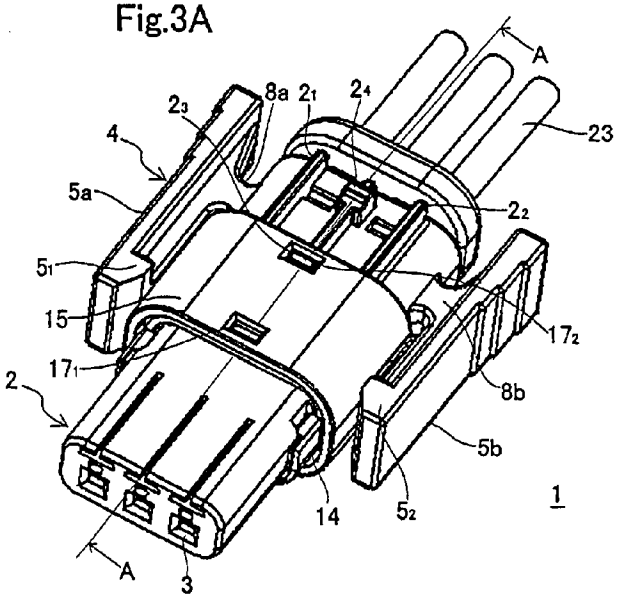
Figure 3B:
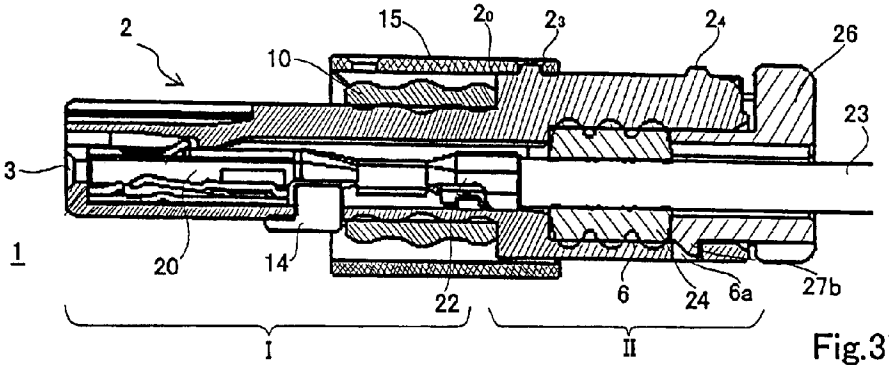
FIG. 3B is an A—A sectional view of FIG. 3A.

Further, a plurality of attaching holes 3, into which the plurality of contact terminals 20 is inserted, is formed from the front surface 2*c* toward the rear surface 2*d*. Further, as shown in FIG. 3B, a cavity 6 where a wire seal 24 and a seal cover 26 are installed is formed at the rear surface 2*d*. In the cavity 6, an opening 6*a* is formed on one part of its inner wall, and a protrusion 27*b* of the seal cover 26 is locked into the opening 6*a*.

A locking mechanism 4 for locking another connector is provided on the outer wall of the fixing portion II, that is, on the sidewalls 2*e*, 2*f*.

Figure 3C:
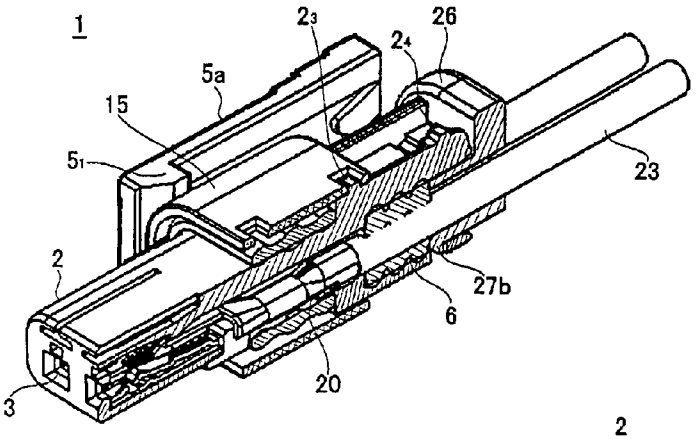
FIG. 3C is an A—A sectional perspective view of FIG. 3A.

The locking mechanism 4 consists of a pair of operating pieces 5*a*, 5*b* that are fixed to the sidewalls 2*e*, 2*f* by support arms 8*a*, 8*b* as shown in FIG. 3. Each of the operating pieces 5*a*, 5*b* consists of a plate-shaped piece having a predetermined length, where locking nails $\mathbf{5}_1$, $\mathbf{5}_2$ are formed at the tip and each such piece can be swung by using the support arm 8*a*, 8*b* as a fulcrum.

In the locking mechanism 4, when the rear ends of the operating pieces 5*a*, 5*b* are pressed with one's fingers, they can be made to swing by using the support arms 8*a*, 8*b* as fulcrums, while the tip portions where the locking nail $\mathbf{5}_1$, $\mathbf{5}_2$ are formed can be moved in the direction away from the sidewalls 2*e*, 2*f*, thereby facilitating engagement as well as removal of the connector from the other connector 30. Further, since the locking mechanism 4 is provided on both sidewalls 2*e*, 2*f* of the flat main body housing, the connector can be made thin even when the locking mechanism is provided.

Furthermore, in the main body housing 2, a concave groove 7, into which a retainer 14 is installed, is formed on both sidewalls 2*e*, 2*f* and a bottom surface 2*b*, except for the top surface 2*a*. The retainer 14 grips the contact terminals 20 that are inserted into attaching holes 3 of the main body housing 2. Further, as shown in FIG. 3A, two guide rails $\mathbf{2}_1$, $\mathbf{2}_2$ and two locking protrusions $\mathbf{2}_3$, $\mathbf{2}_4$ are formed on the top surface 2*a* in the longitudinal direction. The two guide rails $\mathbf{2}_1$, $\mathbf{2}_2$ are provided at positions closer to the sidewalls 2*e*, 2*f*, and the two locking protrusions $\mathbf{2}_3$, $\mathbf{2}_4$ are provided on a central line between the guide rails $\mathbf{2}_1$, $\mathbf{2}_2$ at a predetermined distance (refer to FIG. 3A).

The connector seal 11 comprising an elastic member such as rubber material consists of a tubular body having predetermined length and thickness as shown in FIG. 1. The connector seal 11 has a through hole 12, the opening of which is large enough to fit the insertion with a projected portion I of the main body housing 2. The connector seal 11 is several millimeters thick but is shorter compared to the main body housing 2 in the longitudinal direction. Further, wavelike concave and convex portions 13 are formed on the surface of the connector seal 11, whereby the convex portions 13 are pressed against the inner circumference wall of the housing of the other connector into close contact, thereby preventing water from permeating the connector.

Figure 2C:
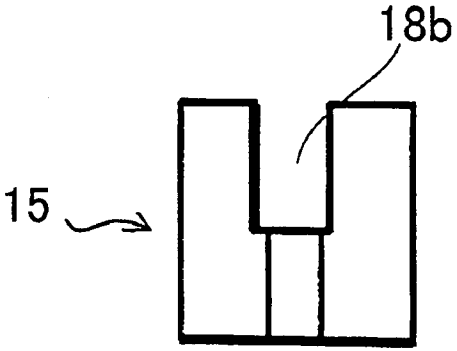
FIGS. 2B and 2C represent the front and side views, respectively, of the sliding hood.
Figure 2A:
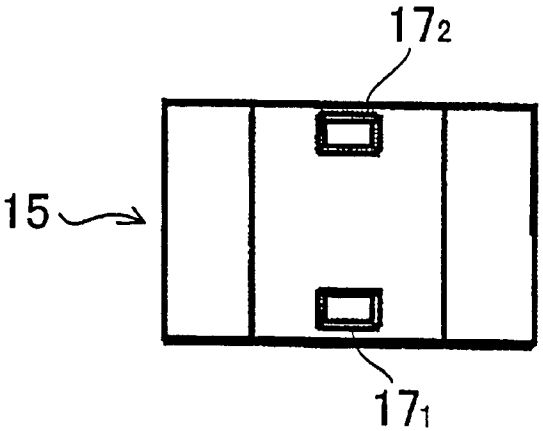
Figure 2B:
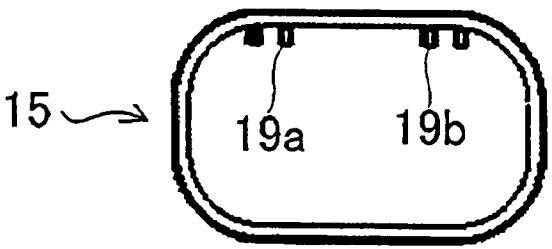

The sliding hood 15 comprising an elastic member such as synthetic resin (PBT) consists of a tubular body having predetermined length and thickness as shown in FIGS. 1 and 2B, and has a through hole 16, the opening of which is large enough to enable the sliding hood 15 to slide on the connector seal 11 that has been installed in the insertion with a projected portion I of the main body housing 2. The sliding hood 15 is several millimeters thick but is slightly longer than the connector seal 11.

Furthermore, in the sliding hood 15, two engaging holes $\mathbf{17}_1$, $\mathbf{17}_2$ and notched grooves 18*a*, 18*b* are respectively formed on the surface and on the sidewalls thereof as shown in FIG. 2A and FIG. 2C. Incidentally, the notched groove 18*a* is provided on a sidewall opposite the notched groove 18*b*, but it is hidden and not shown in FIGS. 1 and 2C.

Each engaging hole $\mathbf{17}_1$, $\mathbf{17}_2$ is formed on both ends so as to be engaged with the locking protrusions $\mathbf{2}_3$, $\mathbf{2}_4$ of the main body housing 2. Further, each notched groove 18*a*, 18*b* has a size and a length as to be fitted with and guided by the support arms 8*a*, 8*b* of the main body housing 2, and can move in the longitudinal direction. In addition, guide rails 19*a*, 19*b*, each of which consists of a pair of convex fins, are formed on the upper portion of the inner circumference of the through hole 16.

The guide rails 19*a*, 19*b* are guided by two guide rails $\mathbf{2}_1$, $\mathbf{2}_2$, enabling the sliding hood 15 to slide smoothly. (Refer to FIGS. 1 and 3A).

The contact terminals 20, which are made of metallic material having good electrical conductivity, have tubular contact portions 21 into which the pin contacts of another connector are inserted and terminal portions 22 to which lead wires 23 are connected when the connector is used, as shown in FIG. 1.

The contact terminals 20 are sealed by the wire seal 24 and the seal cover 26 to prevent water traveling along the lead wires 23 in the state where the main body housing 2 is attached, from permeating the main body housing 2.

The wire seal 24 comprising an elastic member such as rubber material, consists of a flat block body having through holes 25*a* into which the contact terminals 20 (three are shown in FIG. 1) are inserted. The openings of the through holes 25*a* are large enough to fit the circumference of the lead wires 23 after the tubular contact portions 21 of the contact terminals 20 are inserted into the through holes 25*a* to prevent water from permeating the connector (refer to FIG. 3B). Further, wavelike concave and convex portions 25*b* are formed on the surface of the circumference of the wire seal 24.

The seal cover 26 is a cover for holding the wire seal 24 to prevent it from dropping off after the seal 24 has been installed into the cavity 6 of the main body housing 2 and prevents water from permeating the connector, and consists of a block body having a projected portion 27 that is pressed into the cavity 6, a flange 28 that presses against the end of the rear surface 2*d* of the main body housing 2, and through holes 27*a* into which the contact terminals 20 are inserted. Locking protrusions 27*b* are formed on the projected portion 27. (Refer to FIGS. 3B and 3C).

Figure 5:
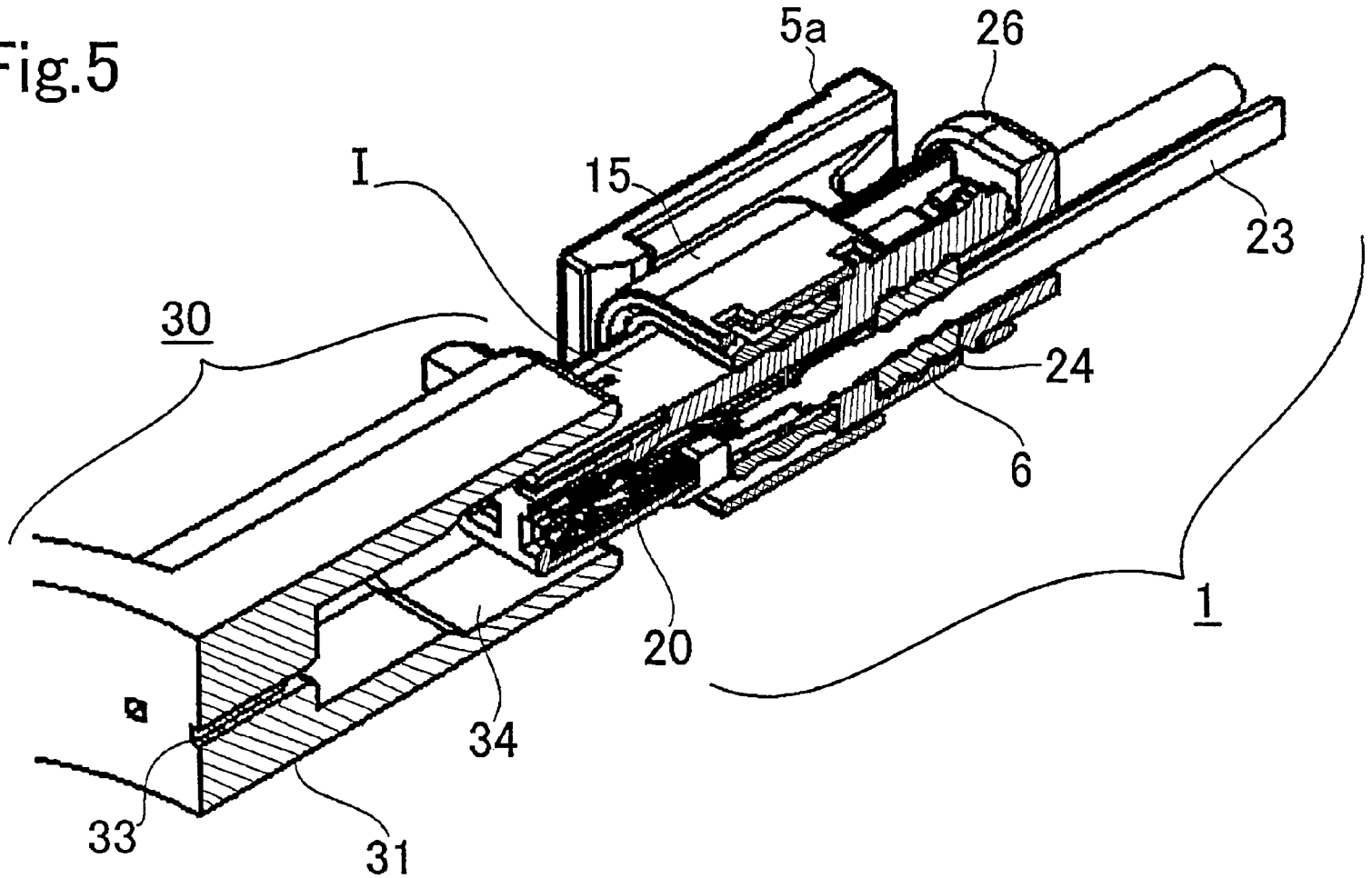
FIG. 5 is a B—B sectional view of FIG. 4A.
Figure 6:
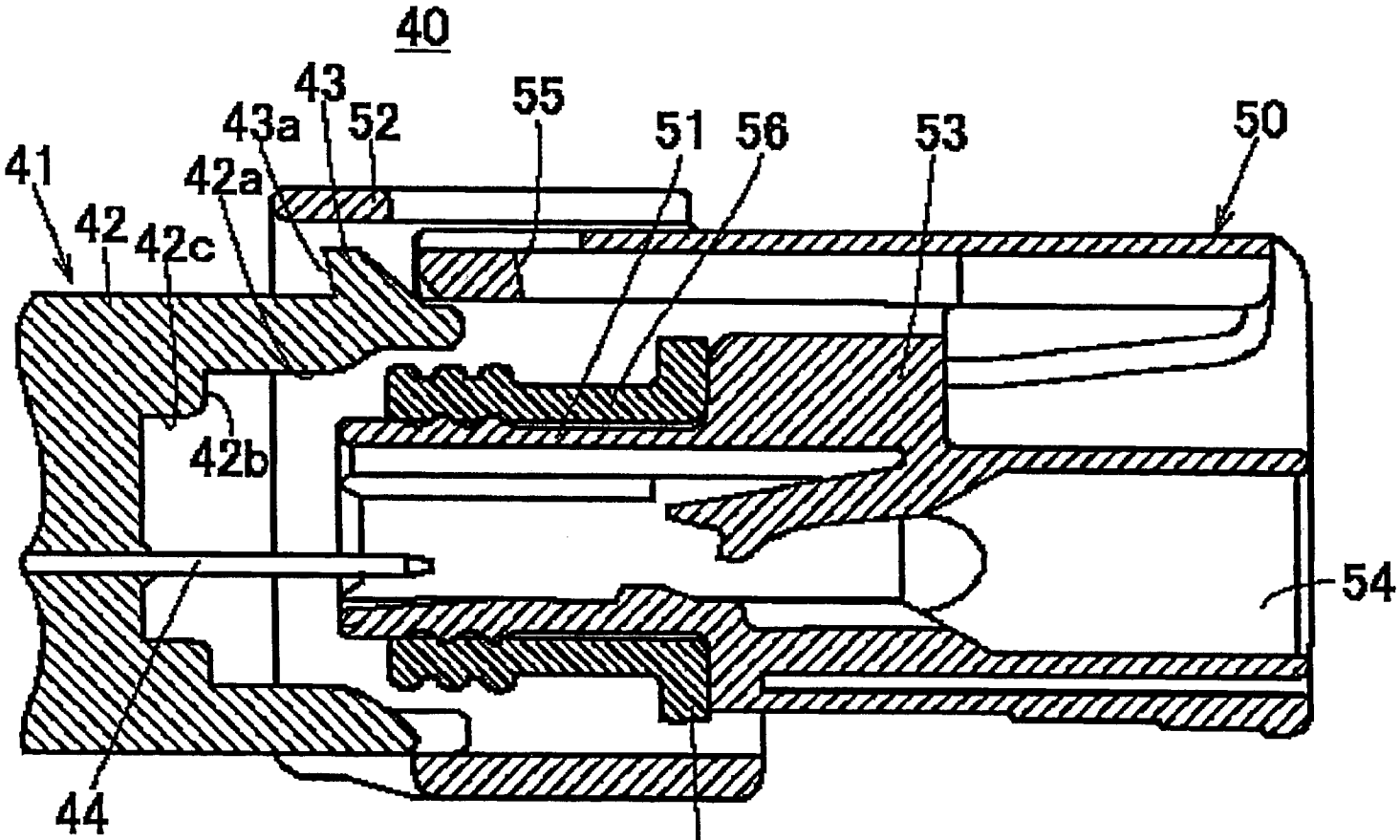
FIG. 6 is a sectional view of the waterproof connector of prior art.

Furthermore, as shown in FIGS. 4 and 5, the other connector 30 connected to the waterproof connector 1 includes a plurality of contact terminals (not shown) and a housing 31 made of synthetic resin material similar to that of the main body housing 2 of the waterproof connector 1, comprising a flat block body having a predetermined width, height and length, into which the contact terminals are installed.

As shown in FIG. 5, a cavity portion 34, into which the insertion with a projected portion I is inserted, is formed in the housing 31 in the connecting direction with the waterproof connector 1. The cavity portion 34 from the connection surface is formed deep enough to accommodate the insertion with a projected portion I. Further, insertion holes 33 communicating from the end portion of the housing 31 to the cavity portion 34 thereof are formed for inserting/installing the contact terminals of the connector (not shown). Moreover, locking protrusions 32*a*, 32*b* are formed at positions near the connection surface of the housing 31. (Refer to FIG. 4A).

The manner of assembling the waterproof connector and connecting it to another connector will be described hereafter with reference to FIGS. 1 to 5.

In the assembly of the waterproof connector 1, the connector seal 11 is fitted onto the insertion with a projected portion I of the main body housing 2, and installed in such manner as to come into contact with a step portion $\mathbf{2}_0$ of the housing 2. During the process of installation, the through hole 12 expands as the elastic connector seal 11 is pressed down along the projected portion I of the main body housing 2. Thereafter, the sliding hood 15 is slid over the connector seal 11, with the engaging hole $\mathbf{17}_2$ of the sliding hood 15 becoming engaged with the locking protrusion $\mathbf{2}_3$ of the housing 2. At this point, the sliding hood 15 is allowed to slide after a pair of the guide protrusions 19*a*, 19*b* and the notched grooves 18*a*, 18*b* are respectively engaged with the guide rails $\mathbf{2}_1$, $\mathbf{2}_2$ and the support arms 8*a*, 8*b*, thereby permitting the sliding hood 15 to glide.

On the other hand, the contact terminals 20 are inserted into the through hole 27*a* of the seal cover 26 and through hole 25*a* of the wire seal 24 at a position remote from the main body housing 2, the seal cover 26 and the wire seal 24 pressed/inserted into the cavity 6 at the rear surface 2*d* of the housing 2, with the locking protrusion 27*b* of the seal cover 26 becoming engaged with the opening 6*a* of the housing 2 (refer to FIGS. 1, 3B and 4A). In the process of insertion, the tubular contact portions 21 of the contact terminals 20 are inserted at the point closer to the front surface 2*c* of the housing 2, after which the retainer 14 is affixed to the concave groove 7 of the housing 2 to clamp the terminals, and assembly of the waterproof connector is completed.

Next, as shown in FIGS. 4A and 5, in connecting the other connector 30 to the waterproof connector 1, the insertion with a projected portion I is inserted into the cavity portion 34 of the connector 30, by which the tip of the housing 31 of the connector 30 is made to come into contact with one end of the sliding hood 15 which is pressed down. Although the engaging hole $\mathbf{17}_2$ of the sliding hood 15 is engaged with the locking protrusion $\mathbf{2}_3$ the hood can be easily disengaged and pressed down because it is made of synthetic resin.

The sliding hood 15 is further pressed down such that the engaging hole $\mathbf{17}_1$ becomes engaged with the locking protrusion $\mathbf{2}_3$ and the connector seal 11 is pressed against the inner wall of the cavity 31 to prevent water from permeating the connector from the connected portion.

According to the present invention, the tubular sliding hood is installed as to be freely slidable on the tubular connector seal that has been fitted to the main body housing, thereby rendering the outer tube portion that serves as a housing in the prior art unnecessary, such that the connector can be made smaller. Particularly, when the main body housing is formed with a flat block body, the waterproof connector can be constructed thinly making it adaptable to devices requiring a thin unit.

In addition, since the connector seal is covered by the sliding hood when it is not connected to another connector, it will not be exposed to the risk of being hit or damaged by an object. Furthermore, dirt, dust, or the like will not easily accumulate on the seal, as it is pressed against the inner circumference of the connector housing when connected to another connector. In such good condition, it is possible to prevent water from permeating or penetrating the connector.

Furthermore, according to one aspect of the present invention, the main body housing comprises an insertion with a projected portion that is connected to another connector in a fitted manner and a fixing portion for fixing the lead wires connected to the contact terminals, with the insertion with a projected portion being longer than the fixing portion in the longitudinal direction, so that another connector can be inserted deeper into the housing of this connector during connection. Consequently, insertion and connection are stabilized, since the distance from the outside to the connector terminals gradually increases as to prevent water from permeating the connector, thereby achieving waterproofness. Therefore, a stable connection state can be maintained even without the outer tube portion of the housing of the prior art.

Further still, according to another aspect of the present invention, since the sliding hood is an elastic member equipped with engaging portions which are in turn engaged with the locking protrusions provided on the main body housing when the water connector is not connected to another connector, the movement of the sliding hood is minimized when it is not connected, thereby securing protection or the like of the connector seal.

Further still, according to another aspect of the present invention, since the main body housing is provided with the locking mechanism that is engaged with another connector near the rear end where the contact terminals are inserted, engagement with another connector can be performed and maintained during use. Additionally, since the main body housing of the water connector of the present invention does not require the outer tube portion of the prior art, the locking mechanism can be provided on the main body housing itself, such that the housing can be made smaller. Moreover, if the main body housing is made of a flat block it can be constructed thinly, since the locking mechanism can be disposed on the narrow sidewall thereof.

Further still, according to another aspect of the present invention, guide protrusions and notched grooves having a predetermined length are respectively formed on the inner circumference wall and sidewalls of the sliding hood with a tubular body, whereby guide protrusions are engaged with the guide rails provided on the main body housing and notched grooves are allowed to slide while crossing the support arms of the locking mechanism when the waterproof connector of the present invention is connected to another connector, so that the sliding hood moves smoothly, therefore facilitating connection with another connector.

Further still, according to another aspect of the present invention, in the through holes of the main body housing, the cavity portion is formed at one side where the contact terminals are inserted and the sealing member is installed inside the cavity portion, making it possible to prevent water traveling along the lead wires connected to the contact terminals from permeating the connector.

Further still, according to another aspect of the present invention, the connector can be made smaller in accordance with the waterproof connector described in any of claims 1 to 6. By using the waterproof connector, it is possible to prevent water from permeating or penetrating the connector from the connected portion, particularly, by making the cavity portion longer in which the insertion with a projected portion I is inserted, thereby establishing a stable connection. Therefore, it is possible to establish and maintain a stable connection even without the outer tube portion of the housing of prior art. In addition, since the distance from outside to the connector terminals gradually increases as to prevent water from permeating the connector, waterproofness is achieved.

What is claimed is:

1. A waterproof connector, comprising:

a plurality of contact terminals adapted to be connected to a plurality of contact terminals of mating connector;

a main body housing having a through hole for housing the plurality of contact terminals;

a connector seal made of an elastic member and fitted around an outer wall of the main body housing, wherein the connector seal is pressed against an inner wall of a housing of the mating connector when the waterproof connector is connected to the mating connector and a sliding hood disposed on the main body housing and configured to be slidable on the connector seal, wherein the sliding hood comes into contact with a tip of the housing of the mating connector when the waterproof connector is connected to the mating connector, thereby the connector seal is fitted against the inner wall of the housing of the other connector to prevent leaking of water.

2. The waterproof connector according to claim 1, wherein the main body housing comprises:

a projected portion to be connected to the mating connector in a fitted manner; and a fixing portion for fixing lead wires that are connected to the plurality of contact terminals, and wherein the projected portion is longer than the fixing portion in a longitudinal direction thereof.

3. The waterproof connector according to claim 1, wherein the sliding hood comprises an elastic member forming a tubular body and engaging portions formed on the elastic member, wherein the engaging portions are engaged with locking protrusions provided on the main body housing when the waterproof connector is disconnected to the mating connector.

4. The waterproof connector according to claim 2, wherein a locking mechanism is provided on an inner wall of the fixing portion of the main body housing to engage with the mating connector.

5. The waterproof connector according to claim 4, wherein guide protrusions are formed on the inner wall and at least one notched groove having a predetermined length is formed on sidewalls of the sliding hood, wherein the guide protrusions are engaged with guide rails provided on the main body housing, and wherein the notched grooves are disposed so as to slide while crossing support arms of the locking mechanism when the waterproof connector is connected to the mating connector.

6. The waterproof connector according to claim 2, wherein a cavity is formed at one side of the fixing portion where the plurality of contact terminals are inserted, and wherein a sealing member is disposed inside the cavity so as to be detachable.

7. The waterproof connector according to claim 2, wherein the sliding hood comprises an elastic member forming a tubular body and engaging portions formed on the elastic member, wherein the engaging portions are engaged with locking protrusions provided on the main body housing when the waterproof connector is disconnected to the other connector.

8. The waterproof connector according to claim 3, wherein a locking mechanism is provided on an inner wall of the fixing portion of the main body housing to engage with the mating connector.

9. The waterproof connector according to claim 7, wherein a locking mechanism is provided on an inner wall of the fixing portion of the main body housing to engage with the mating connector.

10. A connector set, comprising:

a first connector, wherein the first connector comprises:

a plurality of first contact terminals, a first housing having a through hole for housing the plurality of first contact terminals, a connector seal made of an elastic member and fitted around an outer wall of the first housing, and a sliding hood disposed on the first housing and configured to be slidable on the connector seal; and a second connector to be connected to the first connector, wherein the second connector comprises:

a plurality of second contact terminals, and a second housing for housing the plurality of second contact terminals, wherein the second housing includes a cavity into which a projected portion of the first housing of the first connector is fitted, and wherein the sliding hood of the first connector comes into contact with a tip of the second housing of the second connector and the connector seal of the first connector is pressed and fitted against an inner wall of the second housing of the second connector to prevent leaking of water when the first connector and the second connector are connected to each other.

* * * * *